United States Patent [19]

John et al.

[11] Patent Number: 4,993,848

[45] Date of Patent: Feb. 19, 1991

[54] THRUST BEARING SYSTEM FOR COUNTER-ROTATING PROPELLER SHAFTS, PARTICULARLY SHIPS PROPELLER SHAFTS

[75] Inventors: Erich John, Augsburg; Wilhelm Schaefer, Witten, both of Fed. Rep. of Germany

[73] Assignee: Renk Tack GmbH, Fed. Rep. of Germany

[21] Appl. No.: 470,887

[22] Filed: Jan. 25, 1990

[30] Foreign Application Priority Data

Feb. 16, 1989 [DE] Fed. Rep. of Germany ..... 3904719

[51] Int. Cl.[5] ..... F16C 3/00; B63H 23/00; B64C 11/48; B64D 35/06

[52] U.S. Cl. ..... 384/97; 384/420; 415/69; 416/128; 440/81

[58] Field of Search ..... 384/97, 420, 428; 244/69; 415/60, 68, 69, 104, 107; 416/124, 128; 440/81, 80

[56] References Cited

U.S. PATENT DOCUMENTS

| | | | |
|---|---|---|---|
| 2,789,021 | 4/1957 | Pedersen | 416/128 X |
| 3,167,361 | 1/1965 | Snapp et al. | 384/97 |
| 3,469,556 | 9/1969 | Campbell et al. | 440/81 |
| 3,515,449 | 6/1970 | Harbage, Jr. | 384/97 |
| 4,426,049 | 1/1984 | Stewart | 244/69 |
| 4,642,059 | 2/1987 | Nohara | 440/81 X |

FOREIGN PATENT DOCUMENTS

| | | |
|---|---|---|
| 1905921 | 11/1972 | Fed. Rep. of Germany . |
| 6916569 | 6/1973 | Fed. Rep. of Germany . |
| 2409242 | 8/1975 | Fed. Rep. of Germany . |

OTHER PUBLICATIONS

Hansa, 109 Annual, No. 14, pp. 1279–1286, by H. Meier-Peter, "Maschinenbauliche Gesichtspunkte bei gegenlaufigen Antriebssystemen fur seegehende Handelsschiffe", 1972.

*Primary Examiner*—Thomas R. Hannon
*Attorney, Agent, or Firm*—Darby & Darby

[57] ABSTRACT

Two propeller shafts are disposed coaxially one within another. A collar of the inner propeller shaft grips into the hollow outer propeller and supports the inner shaft axially over axial friction bearing elements. The axial friction bearing elements are surrounded by a shaft connecting piece, which is divided in the axial direction and at least one half of which can be removed radially, in order to create access to the axial friction bearing elements. By way of the axial friction bearing elements, axial forces of the inner propeller shaft reach the hollow outer propeller shaft and, from the latter, by way of further axial friction bearing elements, further reach a bearing housing, which is preferably also divided in the longitudinal direction.

4 Claims, 1 Drawing Sheet

12
48
14
11
48
40
30
20
13
10
44
46
29
31
15'
28
21
16
11
45
50
19
14'
27
15
18
7
26
25
32
52
24
34
48
2
1
25
42
3
4

THRUST BEARING SYSTEM FOR COUNTER-ROTATING PROPELLER SHAFTS, PARTICULARLY SHIPS PROPELLER SHAFTS

FIELD OF THE INVENTION

The invention relates to a thrust bearing system for counter-rotating propeller shafts, particularly ships' propeller shafts.

BACKGROUND OF THE TECHNICAL ART

Thrust bearing systems for counter-rotating propeller shafts for ships' propellers are known from FIGS. 19 and 20 of the publication "HANSA - Schiffahrt - Schiffbau - Hafen", volume 109, No. 14, 1972, page 1285. Counter-rotating ships, propeller shafts are also known from the German Auslegeschrift No. 1,272,157 and the German Auslegeschrift No. 1,905,921. Axial thrust bearings, each with a plurality of friction bearing elements between annular friction bearing surfaces for ships, propeller shafts are known from the German Offenlegungsschrift No. 2,409,242 and the German Utility Patent No. 6,916,569.

OBJECTS AND SUMMARY OF THE INVENTION

It is an object of the invention to provide a thrust bearing system which will ensure a reliable transfer of forward and backward thrust, the individual components of which are accessible in a simple fashion for inspection and maintenance.

Pursuant to the invention, this objective is accomplished in a system including two propeller shafts disposed coaxially, one within the other. A collar of the inner propeller shaft grips into the hollow outer propeller shaft and supports the inner shaft axially over axial friction bearing elements. The axial friction bearing elements are surrounded by a shaft connecting piece, which is divided in the axial direction and at least one half of which can be removed radially, in order to create access to the axial friction bearing elements. By way of the axial friction bearing elements, axial forces of the inner propeller shaft reach the hollow outer propeller shaft and, from the latter, by way of further axial friction bearing elements, further reach a bearing housing, which is preferably also divided in the longitudinal direction.

Further features of the invention are described below with reference to the detailed description of a preferred embodiment.

DESCRIPTION OF THE DRAWINGS

The invention is described in the following detailed description in relation to the drawings, in which.

DETAILED DESCRIPTION OF THE DRAWINGS

Figures 1, 2, 3:
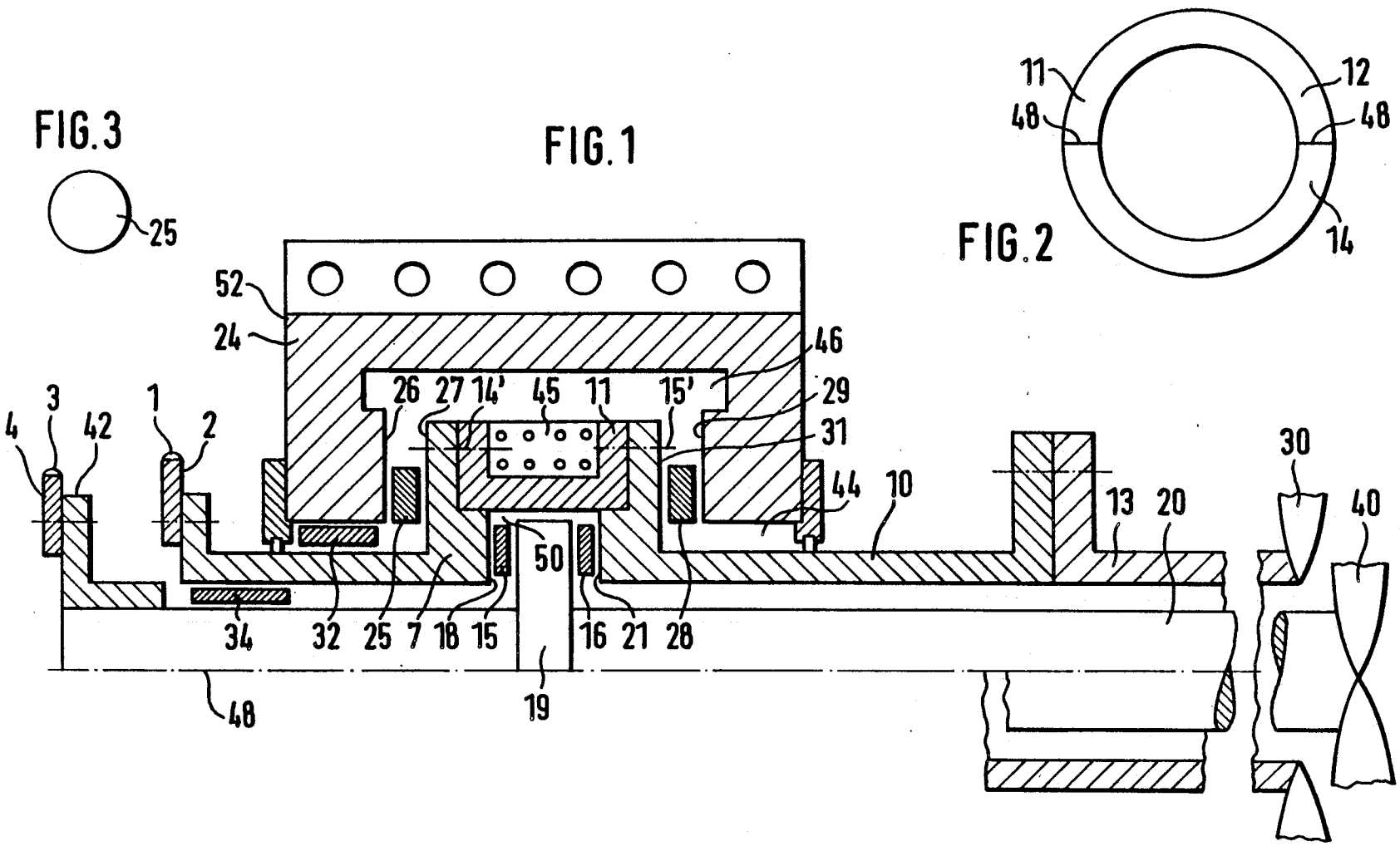
FIG. 1 shows a partial axial section through a thrust bearing system for counter-rotating ships' propeller shafts according to principles of the invention.
FIG. 2 shows the shaft connecting piece of FIG. 1 on a reduced scale, comprising two semi-annular parts which are assembled radially.
FIG. 3 is an axial view of an axial friction bearing element of FIG. 1.

FIG. 1 is an axial half-section through a preferred embodiment of the inventive thrust bearing system for counter-rotating ships' propeller shafts. Over a transmission system (not shown), a driving engine (not shown}drives two concentrically disposed, connectable toothed coupling sleeves, one of which engages the coupling toothing 1 of a coupling hub 2 and the other a coupling toothing 3 of a coupling hub 4. The coupling hub 2 drives a hollow propeller shaft 13 which is attached to a ship's propeller 30 via a hollow shaft section 7, a shaft connecting piece 11, and a hollow shaft section 10, all of which are connected together as illustrated.

The other coupling hub 4 is detachably connected via a connecting piece 42 with a coaxially inner propeller shaft 20. The shaft connecting piece 11 is divided in the longitudinal (axial) direction, as shown in FIG. 2, and consists of two semi-annular halves 12 and 14. By these means, the two halves 12 and 14 can be dismantled and separated after their screw connections 14' and 15' with the hollow shaft sections 7 and 10 are undone, in order to gain access to the annularly disposed axial friction bearing elements 15 and 16 located radially inwardly of connecting piece 11. The axial friction bearing elements 15 are disposed between a friction bearing surface 18 on the front face of hollow shaft section 7 and a collar 19 mounted on the inner propeller shaft 20, which carries a ship's propeller 40. The axial friction bearing elements 16 are between the collar 19 and an axial friction bearing surface 21 on the rear face of the hollow shaft piece 10.

A bearing housing 24, much like the shaft connecting piece 11, consists of two semi-annular housing parts and surrounds the shaft connecting piece 11. Axial friction bearing elements 25 are disposed in an annular arrangement between a forward facing friction bearing surface 26 of the bearing housing 24 and an opposed friction bearing surface 27 of the hollow shaft section 7. Axial friction bearing elements 28 are annularly disposed between a friction bearing surface 29 of the bearing housing 24 and an opposed front facing friction bearing surface 31 of the hollow shaft section 10. The two friction bearing surfaces 26 and 29 are annular and are disposed opposite one another and contain between them the friction bearing surfaces 27 and 31, respectively. The shaft connecting piece 11 is disposed axially between the friction bearing surfaces 27 and 31.

The axial friction bearing elements 15, 16, 25 and 28 are disposed in annular fashion and preferably have, viewed in the axial direction, a circular shape, corresponding to that of the single axial friction bearing element 25 shown in FIG. 3. A journal bearing 32 between the bearing housing 24 and the hollow shaft section 7 provides for the concentric guidance of the hollow propeller shaft 13 and a further journal bearing 34 between the hollow shaft section 7 and the inner propeller shaft 20 provides for a concentric guidance of propeller shaft 20 with respect to the hollow, outer propeller shaft 13.

The forward thrust is transferred from the rear propeller 40 over the inner propeller shaft 20 to the collar 19 and from there over the axial friction bearing elements 15, the outer hollow shaft section 7 and the axial friction bearing elements 25 to the bearing housing 24. The forward thrust is then transmitted from the bearing housing 24 to a substructure of the ship (not shown).

The forward thrust of the front propeller 30 is transferred over the hollow propeller shaft 13 and its hollow shaft section 10, which is disposed axially thereto, and then over the shaft connecting piece 11, which is divided in the longitudinal direction. From connecting piece 11, said forward thrust is also conducted to the hollow shaft section 7 and, from it, via the axial friction bearing elements 25 to the bearing housing 24.

The reverse thrust is transmitted via the radially inner propeller shaft 20 to collar 19 and then onto the other axial friction bearing elements 16. From the latter, the reverse force travels over the hollow shaft section 10 and the axial friction bearing elements 28 into the bearing housing 24. The reverse thrust of the outer hollow propeller shaft 13 is transferred over the hollow shaft section 10 to the axial friction bearing elements 28 and, from them, to the bearing housing 24.

By means of the invention, not only is the thrust for the forward motion and for the reverse motion transferred reliably over the thrust bearing system, but also the individual components of this thrust bearing system are accessible in a simple fashion for inspection and maintenance. This concerns particularly the axial friction bearing elements 15 and 16 of the rear propeller 40 and the axial friction bearing elements 25 and 28 of the front propeller 30, the thrust of the rear propeller 40 also passing over the last-mentioned axial friction bearing elements 25 and 28.

The thrust bearing system forms a constructional unit, which also includes the radial bearings 32 and 34. These, like the hollow shaft section 7, can be divided in the axial direction; they each consist of two semicircular ring halves. The thrust bearing system is disposed between the propellers 30 and 40 and the ship's transmission, which is not shown. The forward thrust of the two propellers 30 and 40 acts directly in the axially divided bearing housing 24. The axial friction bearing elements 25 and 28 are accessible by removal of the bearing housing 24. The inner axial friction bearing elements 15 and 16 are accessible by the radial removal of the two halves of the shaft connecting piece 11. The radial bearing 34 can be constructed ring-shaped from one piece and be accessible owing to the fact that the coupling hub 4 is detachably connected separably to the inner propeller shaft 20.

The axial and radial clearances between the individual elements are selected so that no stresses are produced by the heat-induced expansions of individual elements. Instead of toothed coupling elements 1, 2, 3 and 4, the two propeller shafts 13 and 20 and, in the case of the propeller shaft 13, the elongated hollow shaft sections 10 and 7, can also be connected by other connecting elements with angular mobility or over radial and/or axial elastic connecting elements to a ship's transmission.

The hollow outer propeller shaft 13, the hollow shaft section 7, the shaft connecting piece 11, and the hollow shaft section 10 together have the effect of a propeller shaft in one piece. Together, they form a hollow propeller shaft body assembly.

The inventive bearing system was described above for counter-rotating coaxial propeller shaft assemblies 7, 10, 11, 13, 20 for ships. The bearing system can, however, also be used for other propeller shafts, such as those of a helicopter. Generally described, the essential characteristics of the invention are as follows:

1.1. A stationary bearing housing 24, which is provided with an opening 44 for the shafts and, in the interior of the housing, with two inwardly facing ring-shaped friction bearing surfaces 26, 29, which are axially opposite one another and some distance apart;

1.2. a radially expanded, collar-like shaft section 45 (with 11, 27, 31) of the hollow, outer shaft assembly 7, 10, 11, 13, which extends axially between the two friction bearing surfaces 26, 29 of the bearing housing 24;

1.3. outer friction bearing surfaces 27, 31 at the collar-like shaft section 45 of the outer shaft assembly 7, 10, 11, 13, each of which is axially opposite to and at a distance from one of the friction bearing surfaces 26, 29 of the bearing housing 24;

1.4. a plurality of outer friction bearing elements 25, 28 between the friction bearing surfaces 26, 29 of the bearing housing 24 and the opposite friction bearing surfaces 27, 31 of the collar-like shaft section 45 of the outer shaft assembly 7, 10, 11;

1.5. the bearing housing 24 is divided in an axial plane 48 into at least two pieces, so that, by the radial removal of one of these pieces of the bearing housing 24, the collar-like shaft section 45 of the hollow, outer shaft assembly 7, 10, 11, 13 and the outer friction bearing elements 25, 28 and the friction bearing surfaces 26, 29, 27, 31, which act together with them, become accessible;

1.6. a groove 50 in the inner periphery in the collar-like shaft section 45 of the hollow outer shaft 7, 10, 11, 13, the front sides of said grooves, which are opposite one another and some distance apart, are constructed as the inner, front-side friction bearing surfaces 18, 21;

1.7. a collar 19 at the inner shaft 20, which protrudes into the inner circumferential groove 50 of the collar-like shaft section 45 of the hollow outer shaft assembly 7, 10, 11, 13 and, at its two front sides, has annular friction bearing surfaces, which lie axially opposite to and at a distance from the inner opposed friction bearing surfaces 18, 21 of the collar-like shaft section 45;

1.8. a plurality of inner friction bearing elements 15, 16 between the friction bearing surfaces of the collar 19 of the inner shaft 20 and the opposed inner friction bearing surfaces 18, 21 of the collar-like shaft section 45 of the hollow, outer shaft assembly 7, 10, 11, 13;

1.9. the collar-like shaft section 45 becomes accessible through the removal of one (piece 52 above the axial plane 48) of the pieces of the bearing housing 24 and is also divided in said axial plane 48 into at least two pieces 12, 14 in such a manner, that by the radial removal of one of these pieces, which are connected detachably to one another, the inner friction bearing elements 15, 16 and the friction bearing surfaces 18, 21, which act together with them, become accessible.

Pursuant to a particular embodiment of the invention, at least one journal bearing 32 is disposed between the bearing housing 24 and the hollow outer shaft assembly 7, 10, 11, 13.

Pursuant to a further embodiment of the invention, the two shaft assemblies 7, 10, 11, 13, 20 are centered relative to one another over a journal bearing 34, which is disposed between these two shafts on that side of the collar 19 of the inner shaft 20, which faces away from the propellers 30, 40, and between this collar 19 and the drive connecting elements 3, 4, which are detachably connected to the inner shaft 20, so that the drive connecting elements 3, 4 can be removed and the journal bearing 34 then pulled from the shafts or inserted between the shafts.

It will be readily apparent to those of ordinary skill in the art that numerous modifications and additions are possible without deviating from the principles of the described invention, which is limited only by the claims.

We claim:

1. A thrust bearing system for counter-rotating coaxial, inner and hollow outer shafts, comprising:

a stationary bearing housing having an axially oriented opening for passage of the inner and outer shafts therethrough, the bearing housing having in its interior first and second axially opposed, spaced apart, ring-shaped friction bearing surfaces therein;

a radially expanded, collar-like shaft section integral with the hollow outer shaft, which collar-like shaft section extends radially between the first and second friction bearing surfaces of the bearing housing;

first and second outer friction bearing surfaces on the collar-like shaft section of the hollow outer shaft, each of which is axially opposite and spaced apart from one of the first and second friction bearing surfaces of the bearing housing;

a plurality of outer friction bearing elements positioned between the first and second friction bearing surfaces of the bearing housing and the opposite first and second outer friction bearing surfaces of the collar-like shaft section of the hollow outer shaft;

the bearing housing being divided in an axial plane into at least two detachably connected parts, whereby upon the radial removal of one of the parts of the bearing housing, the collar-like shaft section of the hollow outer shaft and the outer friction bearing elements and the first and second friction bearing surfaces of the bearing housing and the opposite first and second outer friction bearing surfaces of the collar-like shaft section are made accessible;

the collar-like shaft section of the hollow outer shaft further having a groove in its inner periphery, the groove forming opposed and spaced apart first and second inner friction bearing surfaces;

a collar on the inner shaft protruding radially into the groove of the collar-like shaft section of the hollow outer shaft, the collar having first and second annular friction bearing surfaces positioned axially opposed to and spaced apart from the first and second inner friction bearing surfaces of the collar-like shaft section;

a plurality of inner friction bearing elements disposed between the first and second annular friction bearing surfaces of the collar of the inner shaft and the first and second inner friction bearing surfaces of the collar-like shaft section;

the collar-like shaft section also being divided in an axial plane into at least two detachably connected parts whereby, upon radial removal of one of the parts, the inner friction bearing elements and the first and second annular friction bearing surfaces of the collar of the inner shaft and the first and second inner friction bearing surfaces of the collar-like shaft section are made accessible.

2. The thrust bearing system of claim 1, further comprising at least one journal bearing disposed between the bearing housing and the hollow outer shaft.

3. The thrust bearing system of claim 2, further comprising:

a first propeller connected to an end of the inner shaft;

a drive connecting element detachably connected to the other end of the inner shaft;

a second propeller connected to an end of the hollow outer shaft;

wherein the inner and hollow outer shafts are centered relative to one another over a journal bearing which is disposed between the two shafts on a side of the collar of the inner shaft away from the propellers and between the collar and the drive connecting element, whereby the drive connecting element can be removed and the journal bearing then pulled from the shafts or reinserted between the shafts.

4. The thrust bearing system of claim 1, further comprising:

a first propeller connected to an end of the inner shaft;

a drive connecting element detachably connected to the other end of the inner shaft;

a second propeller connected to an end of the hollow outer shaft;

wherein the inner and hollow outer shafts are centered relative to one another over a journal bearing which is disposed between the two shafts on a side of the collar of the inner shaft away from the propellers and between the collar and the drive connecting element, whereby the drive connecting element can be removed and the journal bearing then pulled from the shafts or reinserted between the shafts.

* * * * *